US006444304B1

(12) United States Patent
Hisamoto et al.

(10) Patent No.: US 6,444,304 B1
(45) Date of Patent: Sep. 3, 2002

(54) ANODIC OXIDE LAYER AND CERAMIC COATING FOR ALUMINUM ALLOY EXCELLENT IN RESISTANCE TO GAS AND PLASMA CORROSION

(75) Inventors: Jun Hisamoto, Kobe; Hiroo Shige, Kakogawa; Koichi Hayashi, Takasago, all of (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/401,405

(22) Filed: Sep. 22, 1999

(30) Foreign Application Priority Data

Oct. 9, 1998 (JP) ..... 10-288010

(51) Int. Cl.[7] ..... B32B 3/26

(52) U.S. Cl. ..... 428/319.1; 428/307.7; 428/701; 428/702; 428/704; 428/698; 428/472; 428/469; 428/446; 428/472.2; 428/697; 428/699; 428/212

(58) Field of Search ..... 428/319.1, 307.7, 428/704, 702, 701, 698, 472, 469, 446, 472.2, 697, 699, 212

(56) References Cited

U.S. PATENT DOCUMENTS

| | | | | |
|---|---|---|---|---|
| 2,036,962 | A | * | 4/1936 | Fischer |
| 2,095,519 | A | * | 10/1937 | Fischer |
| 3,672,972 | A | * | 6/1972 | Dorsey |
| 4,092,169 | A | * | 5/1978 | Kumasaka |
| 4,127,451 | A | * | 11/1978 | Marceau et al. |
| 4,163,083 | A | * | 7/1979 | Pryor |
| 4,882,237 | A | * | 11/1989 | Koyama |
| 5,380,554 | A | * | 1/1995 | Ferrando |
| 5,472,788 | A | * | 12/1995 | Benitez-Garriga |
| 5,756,222 | A | * | 5/1998 | Bercaw et al. |
| 6,027,629 | A | * | 2/2000 | Hisamoto et al. |
| 6,027,792 | A | * | 2/2000 | Yamamoto et al. |
| 6,066,392 | A | * | 5/2000 | Hisamoto et al. |

FOREIGN PATENT DOCUMENTS

| | | | | |
|---|---|---|---|---|
| JP | 56013497 | A | * | 2/1981 |
| JP | 58192949 | A | * | 11/1983 |
| JP | 60205824 | A | * | 10/1985 |
| JP | 63303714 | A | * | 12/1988 |
| JP | 4-99194 | | | 3/1992 |
| JP | 04365882 | A | * | 12/1992 |
| JP | 5-53870 | | | 8/1993 |
| JP | 5-53871 | | | 8/1993 |
| JP | 5-53872 | | | 8/1993 |
| JP | 8144088 | | | 6/1996 |
| JP | 8144089 | | | 6/1996 |
| JP | 8193295 | | | 7/1996 |
| JP | 8260088 | | | 10/1996 |
| JP | 8260196 | | | 10/1996 |
| JP | 08288376 | A | * | 11/1996 |
| JP | 10251871 | | | 9/1998 |
| JP | 11140690 | | | 5/1999 |
| WO | WO-9109991 | A | * | 7/1991 |

* cited by examiner

*Primary Examiner*—Terrel Morris
*Assistant Examiner*—Hai Vo
(74) *Attorney, Agent, or Firm*—Oblon, Spivak, McClelland, Maier & Neustadt, P.C.

(57) ABSTRACT

Aluminum alloy comprising an anodic oxidation coating and a ceramic coating formed on a surface of the anodic oxidation coating, wherein the anodic oxidation coating contains one or more elements selected from the group consisting of C, N, P, F, B and S at a content of each element in an amount of 0.1 mass % or more, and wherein the ceramic coating comprises one or more selected from the group consisting of oxide, nitride, carbonitride, boride and silicide, wherein when the anodic oxidation coating contains S only, the surface of the aluminum alloy or of the anodic oxidation coating has an average roughness Ra of 0.3 $\mu$m or more.

9 Claims, 1 Drawing Sheet

ANODIC OXIDE LAYER AND CERAMIC COATING FOR ALUMINUM ALLOY EXCELLENT IN RESISTANCE TO GAS AND PLASMA CORROSION

BACKGROUND OF THE INVENTION

1. Field of the Invention

The present invention relates to aluminum (hereinafter simply referred to Al) alloy excellent in anti-corrosiveness to gas and plasma and particularly, to Al alloy suitable for a structural material to build an apparatus, in which gas or plasma including a corrosive component and an element is used, such as a production apparatus for semiconductor or liquid crystal.

2. Prior Art

A production apparatus for semiconductor or liquid crystal such as a chemical or physical vapor deposition apparatus, that is CVD or PVD, or a dry etching apparatus is constructed of a heater block, a chamber, liner, a vacuum chuck, an electrostatic chuck, a clamper, bellows, a bellows cover, a susceptor, a gas diffusion plate, and an electrode etc. as main constituents. In the interior of such a production apparatus for semiconductor or liquid crystal, since a corrosive gas, as reaction gas, including a halogen element such as Cl, F, Br and/or the like, and/or elements such as O,N, H, B, S, C and/or the like is introduced, the constituent members are required to have anti-corrosiveness to the corrosive gas. Furthermore, the main constituent members are necessary to have anti-corrosiveness to plasma since halogen containing plasma is also generated in the interior of the production apparatus in addition to presence of the corrosive gas.

Conventionally stainless steel has been used for a structural material of such main constituent members. Under recent demands for high efficiency and light weight of production apparatuses for semiconductor and liquid crystal, however, there has been pointed out following problems in constituent members made from stainless steel: insufficient in thermal conductivity, resulting in slow start-up in operation; heavy in its size, causing the apparatuses to be heavy as a whole. Besides, there have been occurred another problem since heavy metals such as Ni, Cr and the like included in stainless steel have a chance to be released to an environmental atmosphere so as to work as a contaminant source and thereby, deteriorate qualities of a semiconductor product and a liquid crystal product.

For the reason, aluminum alloy light in weight and high thermal conductivity has rapidly been increased in use, substituting stainless steel. Among various kinds of aluminum alloys, for example, JIS 3003 Al alloy including Mn: 1.0 to 1.5% , Cu: 0.05 to 0.20% and the like; JIS 5052 Al alloy including Mg: 2.2 to 2.8%, Cr.: 0.15 to 0.35% and the like; JIS 6061 Al alloy including Cu: 0.15 to 0.40%, Mg: 0.8 to 1.2%, Cr: 0.04 to 0.35% and the like are generally used. However, surfaces of such Al alloys are not good in resistance to corrosion caused by the above described corrosive gases and plasmas. Accordingly, it is indispensable to improve anti-corrosiveness of the Al alloys to the gases and plasmas in order for the Al alloys to be adopted as structural material of production apparatuses for semiconductor and liquid crystal. In order to improve the anti-corrosiveness, some treatment on an Al alloy surface is the most effective means.

Therefore, a technique has been proposed in the publication of Examined Japanese Patent Application No. Hei 5-53870, in which an anodic oxidation coating of A1203 excellent in anti-corrosiveness is formed on a surface of the above described Al alloys in order to increase anti-corrosiveness to the gas and plasma of the main constituent members of a vacuum chamber and the like. However, the anodic oxidation coating does not always satisfy requirements for anti-corrosiveness in all kinds of environments in which the main constituent members of a production apparatus for semiconductor are placed since a film quality of the anodic oxidation coating shows a largely different degree of anti-corrosiveness to gas or plasma according to environmental conditions.

For such a reason, there have been proposed various! methods to further improve a quality of an anodic oxidation coating in order to increase anti-corrosiveness of such Al alloys as materials of constituent members used in a semiconductor production apparatus. For example, in the publication of Unexamined Japanese Patent Application No. Hei 8-144088, a proposal is such that in formation of an anodic oxidation coating, an initial voltage for anodic oxidation is higher than a final voltage. Further, a proposal has been made in the Unexamined Japanese Patent Application No. Hei 8-144089, in which anodic oxidation is performed in a solution including a phosphate ion and a sulfate ion and a total opening area of pores on an anodic oxidation coating surface is adjusted in a specific range. Still further, other proposals appear in the publications in the Unexamined Japanese Patent Application Nos. Hei 8-260195 and Hei 8-260196, which disclose techniques in which a porous anodic oxidation coating is first formed and then, a coating by non-porous anodic oxidation is overlapped.

Any of such conventional techniques relating to anodic oxidation, as shown in FIG. 1, has a fundamental feature that recesses each called a pore 3 are started to be formed on a surface of a base material Al alloy 1 on start of electrolysis, continuing to be formed in progress of the oxidation and thereby, there is formed an anodic oxidation coating 6 comprising a porous layer 4 constructed of cells 2 that grows along the depth direction of the Al alloy 1 and a barrier layer 5. Since the barrier layer 5 has no gas permeability, gas or plasma is prevented from being put into contact with Al alloy. In the publication of Unexamined Japanese Patent Application No. Hei 8-193295 or the like, in order to further increase anti-corrosiveness to a plasma of such double-structured anodic oxidation coating, diameters of pores and cells on the surface side of the porous layer 4 have been proposed so as to be formed as small as possible.

An anodic oxidation coating such that the coating is constructed of the porous layer and barrier layer and diameters of pores and cells on the surface side of the porous layer 4 are formed as small as possible is sure to be excellent in anti-corrosiveness to gas and plasma. However, recent production conditions for semiconductor and liquid crystal have been very severe corresponding to a recent trend toward high efficiency and a large-size scale and gas and plasma related conditions are also severer due to transition toward a high concentration, a high density and high temperature. Accordingly, in recent years, structural materials of a reaction chamber and those of internal constituent members thereof have been required to possess anti-corrosiveness to the increasingly more severe corrosive gases and plasmas including halogen elements such as Cl, F, Br and the like, and elements such as O, N, H, B, S, C and the like, singly or in combination.

For example, evaluation of anti-corrosiveness to a halogen gas and a plasma appeared in the publication of the Unexamined Japanese Patent Application No. Hei 8-193295 is such as, for anti-corrosiveness to halogen gas, no corrosion under test conditions of 300° C.×4 hr in 5% $Cl_2$—Ar and for anti-corrosiveness to plasma, 2 μm or less in etching depth under test conditions of $Cl_2$ plasma exposure for 90 min. On the other hand, anti-corrosiveness criteria required for structural materials of production apparatuses for semiconductor and liquid crystal with high efficiency are such as, for anti-corrosiveness to halogen, no corrosion after two time repetition of exposure to 5% $Cl_2$ containing Ar gas at 400° C. for 60 min and in addition, adhesiveness with no separation of a ceramic coating from an anodic oxidation coating in a tape separation test on the same sample. Further, for anti-corrosiveness to plasma, 1 μm or less in etching depth after repetition of four time of exposure to $Cl_2$ plasma for 60 min and to $CF_4$ plasma for 30 min combined. An anodic oxidation coating obtained only by the above described treatment does not meet such severer requirements for anti-corrosiveness to the gases and plasmas.

On the other hand, in addition to the anodic oxidation coating, as materials excellent in anti-corrosiveness to the corrosive gas and plasma, there are available coatings of ceramic such as oxide ($Al_2O_3$), nitride (AlN), carbonitride (SiCN, AlCN), boride ($TiB_2$), Silicide ($MoSi_2$) and the like. There have sporadically been proposed examples in the publications of Examined Japanese Patent Application Nos. Hei 5-53872 and Hei 5-53871, in which the ceramic coatings are directly applied on an Al alloy surface by arc ion plating, sputtering, thermal spraying, CVD or the like. While the ceramic coatings are, however, without doubt excellent in anti-corrosiveness to halogen and plasma, it does not satisfy the recent severer requirements as in the case of the anodic oxidation coatings.

Therefore, such facts reveal that only individual improvements of an anodic oxidation coating and a ceramic coating have limitations to meet the anti-corrosiveness requirements. In order to satisfy the requirements for anti-corrosiveness to the gas and plasma, it is necessary that a concept of a composite coating is introduced and the ceramic coating is overlapped on the anodic oxidation coating to form a composite coating structure.

However, where a ceramic coating is overlapped on an anodic oxidation coating, a special problem arises in which adhesiveness between an anodic oxidation coating and a ceramic coating is poor. In particular, according to process conditions of production of semiconductor and liquid crystal, the constituent members of production apparatuses for semiconductor and liquid crystal in operation are subjected not only to the environment of a comparatively low temperature of 100° C. or lower, but also to the severe working environments in which heat cycles (repetitions of rise and fall in working temperature) in a temperature range of 200 to 450° C. Accordingly, the aforesaid constituent members require non-separable adhesiveness between an anodic oxidation coating and an Al alloy base material and between an anodic oxidation coating and a ceramic coating, against conditions not only in a range from room temperature to 100° C., but also in high temperature heat cycles, and additionally in the corrosive environments of the gas and plasma, wherein a sample receives a halogen anti-corrosive test.

Therefore, in order to successfully stack a ceramic coating on an anodic oxidation coating, it is necessary to retain the adhesiveness even in the high temperature heat cycles and under the corrosive environment. Such composite coating has not been achieved in prior art, nor provided for practical use, if successful in a laboratory stage. In the publications of Examined Japanese Patent Application Nos. Hei 5-53782, Hei 5-53871, there have actually been disclosed a ceramic coating stacked directly on an Al alloy surface. The reason why is estimated that, as a decisive factor, adhesiveness between an anodic oxidation coating and a ceramic coating cannot be retained under conditions of the high temperature heat cycles and the corrosive environment and therefore, a function and an effect of anti-corrosiveness to the corrosive gas and plasma cannot be exerted.

SUMMARY OF THE INVENTION

The present invention has been made taking such circumstances into consideration and it is accordingly an object of the present invention to provide Al alloy with comprehensive anti-corrosiveness to gas and plasma, which has a composite-structured coating thereon of an anodic oxidation coating and a ceramic coating both excellent in anti-corrosiveness to the gas and the plasma, and whose composite-structured coating is improved especially on adhesiveness between the anodic oxidation coating and the ceramic coating in heat cycles in the range from room temperature (or in a some case, lower than room temperature) to a high temperature and under a corrosive environment.

In order to achieve the object, the features of the present invention is that aluminum alloy of the present invention is aluminum alloy on whose surface an anodic oxidation coating and a ceramic coating are stacked in the order, wherein the anodic oxidation coating contains one or more elements selected from the group consisting of C, N, P, F, B and S each at a content of 0.1% or more and the ceramic coating is made of one or more selected from the group of oxide, nitride, carbonitride, boride and silicide, and/or one or more selected from the group consisting of carbides expressed by MC (wherein M is any of Sif Ti, Zr, Hf, V, Nb, Ta, and Mo) , carbides expressed by $M_2C$ (wherein M is any of V, Ta, Mo and W) , carbides expressed by $M_3C$ (wherein M is any of Mn, Fe, Co and Ni) and carbides expressed by $M_3C_2$ (wherein M is Cr). (Percentage of elements in this specification is mass %.)

In the publication of Unexamined Japanese Patent Application No. Hei 8-193295 as well, it is disclosed that when an anodic oxidation coating contains two or more elements selected from the group consisting of C, S, N, P, F and B, the anodic oxidation coating excellent in anti-corrosiveness to gas and plasma can be obtained. However, in the publication, there are no disclosure that a ceramic coating is further stacked on the anodic oxidation coating that contains such an element and adhesiveness between the anodic oxidation coating that contains such an element and the ceramic coating is excellent especially under conditions of the high temperature heat cycles and an corrosive environment. Further, anti-corrosiveness to gas and plasma is low in degree compared with the present invention as described above.

According to findings by the inventors of the present invention, an ordinary hard anodic oxidation coating formed from an aqueous solution of sulfuric acid as a main component, which process has conventionally been conducted, contains only S of the above described elements. The ordinary hard anodic oxidation coating with only S contained cannot enjoy an effect on improvement of adhesiveness between an anodic oxidation coating and a ceramic coating under conditions of the high temperature heat cycles and an corrosive environment.

However, according to a study of the inventors of the present invention, adhesiveness of the ceramic coating to the anodic oxidation coating can be secured by a physical anchor effect even in a case where the anodic oxidation coating contains only S if a roughness of the hard anodic oxidation coating is increased sufficiently through roughening an Al alloy surface, in a more concrete manner of description, if an average roughness Ra of the Al alloy surface or an anodic oxidation coating is 0.3 μm or more, preferably 0.5 μm or more, or more preferably 0.8 μm or more, in contrast with a surface state of the ordinary hard anodic oxidation coating, that is the hard anodic oxidation coating in the case where surface roughening intentionally or positively is not performed on the Al alloy or the anodic oxidation coating. That is, in a case where an average roughness of a surface of Al alloy or an anodic oxidation coating is adjusted 0.3 μm or more in Ra, an improving effect on adhesiveness even only with S contained can be exerted.

In the present invention, one or more elements selected from the group consisting of C, N, P, F, B and S are each included at 0.1% or more (provided that in a case of S, an average roughness Ra of an Al alloy or an anodic oxidation coating is adjusted to be 0.3 μm or more) and thereby, adhesiveness between the anodic oxidation coating and the ceramic coating under conditions of the high temperature heat cycles and an corrosive environment is improved by a great margin. Further, when S is included in a composite manner in addition to one or more elements selected from the group consisting of C, N, P, F and B, an improving effect on adhesiveness that cannot be obtained with S singly used can be achieved by a composite effect of the other element or elements and S as described later.

Further, by improvement of adhesiveness between the anodic oxidation coating and the ceramic coating, a composite coating structure is enabling in which the anodic oxidation coating is formed on a surface of the Al alloy and a ceramic coating is stacked on the anodic oxidation coating and anticorrosiveness to plasma is guaranteed by the ceramic coating and anti-corrosiveness to halogen gas is guaranteed by the anodic oxidation coating.

DETAILED DESCRIPTION OF THE INVENTION

Composition of Anodic Oxidation Coating

Figure 1:
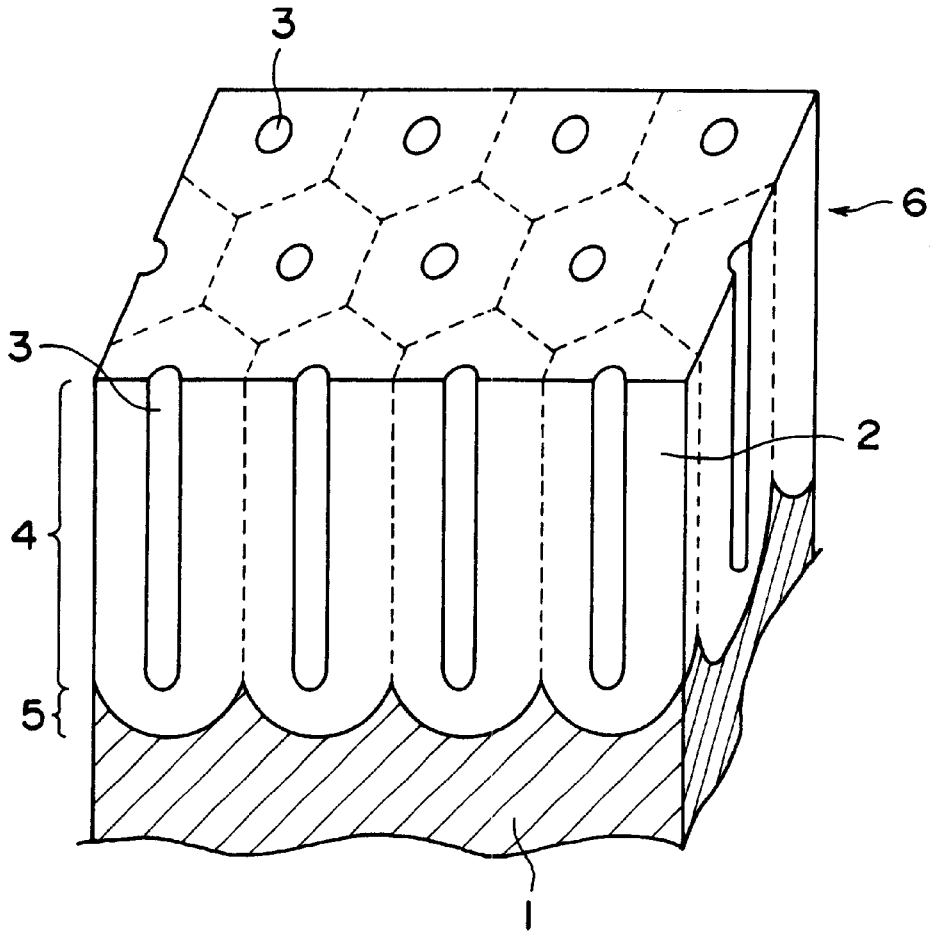
FIG. 1 is a partially sectional view illustrating a general structure of an anodic oxidation coating.

With one or more elements selected from the group consisting of C, N, P, F and B included in the anodic oxidation coating, in order to improve adhesiveness between the anodic oxidation coating and the ceramic coating and between the Al alloy and the anodic oxidation coating under conditions of the high temperature heat cycles and an corrosive environment, required is that at least one element of the elements is included at a content of 0.1% or more. The present inventors have found that, for example, if the anodic oxidation coating contains only C as one kind of the elements at a content 0.1% or more, the selected element or elements that are include in trace can exert an adhesiveness improvement effect along with C even if the other elements are included at a very small content level, say less than 0.1% or of the order 0.01%.

Further, it has been found by the present inventors that if only one element of the above described elements is contained at a content of 0.1% or more, even S that has no adhesiveness improvement effect when singly used can contribute to adhesiveness improvement by a composite effect with the above described elements. Therefore, the lower limit of the numerical range of a content of the elements has a unique and critical significance that if any of the above described elements is included at 0.1% or more in an anodic oxidation coating, a synergy effect that improves adhesiveness under conditions of the high temperature heat cycles and an corrosive environment can be exerted in cooperation with the other elements, though at a content of less than 0.1% even if the other element is in the case of S. Needless to say that when two or more of the above described elements are respectively included at contents of 0.1% or more, the effect can likewise also be exerted.

Inclusion of elements of C, N, P, F and B to the anodic oxidation coating is performed through anodic oxidation in a first aqueous solution of one or more selected from the group consisting of oxalic acid, boric acid, phosphoric acid, phthalic acid, formic acid and the like or a second mixed aqueous solution of sulfuric acid with the first aqueous solution as an electrolytic solution. The method of the inclusion itself has been described in the publication of Unexamined Japanese Patent Application No. Hei 8-193295 as well.

That is, for example, if oxalic acid or formic acid is used as an anodic oxidation solution, HCOOH or $(COOH)_2$, or a first compound composed from H, C and O derived from the original acids or a compound of Al with the first compound is introduced into the anodic oxidation coating and as a result, C is incorporated in the anodic oxidation coating. That is, inclusion of the elements of C, N, P, F and B in the anodic oxidation coating may be conducted in the form of an ion or a compound of an element.

When N is included into the anodic oxidation coating, $HNO_3$, Al $(NO_3)_3$ and the like are added into the acid solution and thereby, a compound including N, such as $HNO_3$ a salt including a $NO_3$ group such as $Al(NO_3)_3$, or the like, is introduced into the anodic oxidation coating with the result that N is incorporated in the anodic oxidation coating.

When P is included into the anodic oxidation coating, P is introduced into the anodic oxidation coating as $H_3PO_4$, H3$PHO_3$ or a salt including a phosphate group such as $AlPO_4$ by anodic oxidation in an aqueous solution of phosphoric acid or a phosphate. Further, $H_3PO_4$, $H_3PHO_3$ or $AlPO_4$ may be added to an aqueous solution of another acid and anodic oxidation is then performed with a mixed acid aqueous solution as an electrolytic solution. When F is included into the anodic oxidation coating, HF is added to the acid aqueous solution and a compound including F or Al and F is incorporated into the anodic oxidation coating.

Further, when B is included into the anodic oxidation coating, $(NH_3)_2B_4O_7$ and $H_3BO_3$ and the like are added to the acid aqueous solution and thereby B is introduced into the anodic oxidation coating as $(NH_3)_2B_4O_7$, $B_2O_3$, borate or the like.

Note that, use of an acid or acids that do not actually contain elements C, N, P, F, and B or that cannot make a necessary amount of the elements included into an anodic oxidation coating formed in anodic oxidation are excluded from the scope of the present invention. For example, there is a problem since for example, use of sulfuric acid as a single acid, or use of an aqueous solution of another inorganic acid such as chromic acid or another organic acid as a single acid provides a poor quality coating and cannot introduce a necessary amount of each of the elements into the anodic oxidation coating and therefore cannot form an anodic oxidation coating excellent in anti-corrosiveness of the present invention under conditions of the high temperature heat cycles and an corrosive environment. However, such an acid or acids that cannot be allowed to be used singly and thereby excluded from the scope of the present invention can be used in an auxiliary manner mixing into the above described oxalic acid, boric acid, phosphoric acid, phthalic acid and formic acid for the purpose to improve a way of forming an anodic oxidation coating itself. However, even in this case, it is an indispensable precondition that an anodic oxidation coating formed by anodic oxidation with the mixed aqueous solution includes the elements C, N, P, F and B at a content of 0.1% or more.

Further, a thickness of the entire anodic oxidation coating is preferably 0.05 μm or more, or more preferably 0.1 μm in order to make the above described excellent anticorrosiveness exerted. However, if a thickness is too large, cracking occurs by an influence of an internal stress, surface coverage comes to be insufficient, separation of the coating is raised and a performance of the coating is thus reduced, Therefore, the thickness is preferably set to be equal to or less than 150 μm.

Anodic Oxidation Treatment Conditions

Then, anodic oxidation treatment conditions are preferably attained by anotic oxidation in an aqueous solution of one or more selected from the group consisting of oxalic acid, boric acid, phosphoric acid, phthalic acid and formic acid and compounds thereof; or by an aqueous solution that is prepared by adding compounds of the elements of C, N, P, F and B to the aqueous solution. In particular, by use of oxalic acid, not only introduction of C into the anodic oxidation coating but also control of a quality and structure of the anodic oxidation coating as shown in FIG. 1 can be performed with ease. Further, if introduction of S together with C is performed using a mixed electrolytic solution of, for example, oxalic acid and sulfuric acid, the object of the present invention can further be achieved to a higher level. Note that, in the present invention, since structural materials of production apparatuses for semiconductor and liquid crystal are objects to be treated, it is excluded as much as possible that an electrolytic solution for anodic oxidation contains an element or elements that are resulted in contamination of products such as semiconductor and liquid crystal.

While concrete conditions for an anodic oxidation treatment are determined so that at least one of the elements C, N, P, F and B is included at a content of 0.1% or more, since an amount of the elements C, N, P, F and B introduced into the anodic oxidation coating also is changed according to a composition and a structure of an Al alloy, concentrations of an acid and a compound of the acid, a temperature of an aqueous solution, a stirring condition, an electric current condition and the like, the conditions are adjusted in a proper manner in anodic oxidation. Note that, an electrolytic solution in which the acid is included at a concentration of 1 g/l or higher is preferably used from the viewpoint of control of a voltage applied in the electrolysis, since control thereof is possible in a broad range and the voltage is selected in the range of 5 to 200V.

Structure of Anodic Oxidation Coating Then, an anodic oxidation coating formed on an Al alloy surface can be formed as one that is excellent in adhesiveness under conditions of the high temperature heat cycles and an corrosive environment as far as at least one of the elements C, N, P, F and B is included at a content of 0.1% or more, even if the structure is a structure comprising a porous layer and a barrier layer, which is an ordinary structure as shown in FIG. 1 or even if a structure constituted of only a barrier layer with no porous layer that is formed from boric acid.

In order to make an anodic oxidation coating with the porous layer and barrier layer exert a higher effect, it is effective to control a structure of the anodic oxidation coating, that is a pore diameter and a cell diameter. For example, when a structure is changed by adjusting a pore diameter and a cell diameter, a residual stress and a stress newly generated by a thermal cycle in the coating can be alleviated. As a concrete example, a pore diameter on the surface side is adjusted to 80 nm or less while a pore on the base material side is adjusted to a diameter larger than the surface side pore diameter. For example, when the pore diameter on the surface side is 20 nm, the pore diameter on the base material side is 30 nm or larger, which is larger than the 20 nn. Further a thickness of the barrier layer is set to 50 nm or more.

When such an anodic oxidation coating is formed, in addition to the above described function, a stress and a volume change in the coating (caused by absorption and desorption of a gas component or a plasma component, and formation of a reaction product with a coating component) produced in contact of a corrosive gas such as halogen and a plasma with the anodic oxidation coating can be alleviated. As a result, cracking and separation of the coating which is start points of corrosion and other damages are suppressed and not only is adhesiveness with the Al alloy surface increased, but also stress produced by a thermal cycle is alleviated. Hence, adhesiveness between an anodic oxidation coating and a ceramic coating and adhesiveness between the anodic oxidation coating and an Al alloy surface under conditions of thermal cycles and a corrosive environment are both improved, thereby making excellent anticorrosiveness togas and plasma realized.

Changes in a pore diameter and a cell diameter in the porous layer in the depth direction may be continuous in an any division or may be discontinuous in any division. Besides, while an anodic oxidation methods have been disclosed in the Unexamined Japanese Patent Application Nos. Hei 8-144088 and Hei 8-260196, the anodic oxidation methods are used as a fabrication method for an anodic oxidation coating in which a pore diameter and a cell diameter of the porous layer 4 on the surface side are formed to be as small as possible, but those diameters on the base material side are formed to be as large as possible and a barrier layer 5 is formed to be large.

In a more concrete manner of description, as described in the publication of Unexamined Japanese Patent Application No. Hei 8-144088, it is acceptable that not only is an initial voltages of anodic oxidation set equal to or less than 50V but a final voltage of the anodic oxidation is set higher than the initial voltage to form the anodic coating. Further, as in the publication of Unexamined Japanese Patent Application No. Hei 8-260198, it is also acceptable that at first, a porous anodic oxidation treatment for forming a porous layer coating having pores is conducted using an electrolysis voltage of 5 to 200 V in a solution (electrolytic solution) of an acid such as sulfuric acid, phosphoric acid or chromic acid and then, a non-porous anodic oxidation treatment for forming a barrier layer is conducted using an electrolysis voltage in the range of 60 to 500V in a solution (electrolytic solution) such as a boric acid based, a phosphoric acid based, a phthalic acid based, an adipic acid base, a carbonic acid based, a citric acid based or a tartaric acid based solution.

Ceramic Coating

A ceramic coating in the present invention is formed using one or more ceramics selected from the group consisting of oxides of various kinds of metals, nitrides thereof, carbonitrides thereof, borides thereof and silicides thereof. Among ceramics, oxides, nitrides, carbonitrides, borides and silicides of metals: Al, Si, B, 4A group (Ti, Zr, Hf and the like), 5A group (V, Nb, Ta and the like) and 6A group (Cr, Mo, W and the like), are preferable from the viewpoint of easiness of forming a coating, hardness and denseness of the coating as compounds including metals with excellency in plasma anti-corrosiveness. Further, a ceramic coating of the present invention may be made of carbide or a mixture with a carbide of any of the other ceramics.

As the oxides, there are named oxides expressed as $MO_2$, $M_2O_3$, $M_2O_5$, $MO_3$ and the like and metals are exemplified as follows: for an MO type oxides, Si, V, Nb, Mg, Be, Ba, Ni, Co, In, and the like; for an $MO_2$ type oxides, Si, Ti, Zr, Hf, Nb, Ta, Cr, Mo, W, La, Mn, Ba and the like; for $M_2O_3$ type oxides, Al, B, Ti, V, Cr, Mn, Nd, In and the like; and for $M_2O_5$ type oxides, Ti, V, Nb, Ta and the like; for $MO_3$ type oxides, V, Cr, Mo, W and the like. As other oxides as well, there can be exemplified: for Ti—O, $Ti_nO_{2n-1}$; for La—Cr—O, LaCrO; for MnO, $Mn_3O_4$; for CoO, $Co_3O_4$; and for InO, $In_2O$. Then, one or more selected oxides from the above described can be used.

As the nitrides, there are named nitrides expressed as MN, $M_4N$, $M_6N_4$, $M_3N$, $M_2N$ and $MN_2$ and metals are exemplified as follows for MN type nitrides, Ti, Zr, Hf, V, Nb, Ta, Cr, Al, B, W and the like; for $M_4N$ type nitrides, Mn, Fe, Co, Ni and the like; for $M_6N_4$ type nitrides, Mn; for $M_3N$ type nitrides, V, Fe, Co, Ni, Cu and the like; for $M_2N$, Ti, Cr, Mn, Fe, Co and the like; and for $MN_2$ type nitrides, Cr, W and the like. As the other nitrides as well, there can be exemplified: for Si—N, $Si_3N_4$; for Mg—N, $Mg_3N_2$; for Mo—N, Mo—N that each have a complex composition; for $M_1$-$M_2$-N, Al—Ti—N and Ti—Hf—N; for $M_1$-$M_2$-$M_3$-N, Al—Ti—Si—N and the like. Then, one or two nitrides selected from the above described can be used.

Further, as carbonitrides, TiCN, TaCN and the like are exemplified. One or more carbonitrides selected among these can be used.

As borides, there are named borides expressed as MB, $M_2B$, $MB_2$ and the like and metals are exemplified as follows: for MB type borides, Cr, Zr, Ti , Fe and the like; for $M_2B$ type borides, Cr, Fe and the like; and for $MB_2$ type borides, Zr, Ti, Ta, AL and the like. Further, as the other borides as well, there can be exemplified: for Cr—B, $Cr_5B_3$, $Cr_3B_4$ and $Cr_4B$; for Zr—B, $ZrB_{12}$; for Co—B, $CO_3B$; for Ta—B, $Ta_3B$; for La—B, $LaB_4$ and $LaB_8$. Ln—Rh—B, wherein Ln is a rare earth metal, can also be exemplified. One or more borides selected among these can be used.

As silicides, there can be named silicides expressed as $M_2Si$, MSi, $MSi_2$, $M_3Si$, $M_3Si_2$, $M_2Si_3$, $MSi_3$ and the like and metals are exemplified as follows: for $M_2Si$ type silicides, Mg, Ti, V, Cr, Mn, Fe, Co, Ni and the like; for MSi type silicides, Cr, Mn, Fe, Co, Ni and the like; for $MSi_2$ type silicides, Ba, Ti, Zr, V, Nb, Ta, Cr, Mo, W, Mn, Fe, Co, Ni and the like; for $M_3Si$ type silicides, Cu, Cr, Ni and the like; for $MSi_3$ type silicides, Cr, Mo, W, Ni and the like; and for $MSi_3$ type silicides, Co. One or more silicides selected among these can be used.

As carbides, there can be named carbides expressed as MC, $M_2C$, $M_3C$, $M_3C_2$ and the like and metals are exemplified as follows: for MC type carbides, Si, Ti, Zr, Hf, V, Nb, Ta, Mo and the like; for $M_2C$ type carbides, V, Ta, Mo, W the like; for $M_3C$ type carbides, Mn, Fe, Co, Ni and the like; and for $M_3C_2$ type carbides, Cr and the like. One or more carbides selected among these can be used.

It has been confirmed by the present inventors that the ceramic coatings shows very high anti-corrosiveness to Cl containing gas such as $Cl_2$, HCl, $BCl_3$ and a plasma thereof, Br containing gas such as HBr and a plasma thereof and F containing gas and plasma thereof such as $NF_3$, $CF_4$, $C_2F_8$, $C_3F_8$, SF, and a plasma thereof, and $ClF_3$ gas, which have especially recently come to be used in a dry etching process. Hence, it is very effective to use the ceramic coatings in environments using such gases and plasmas thereof.

The ceramic coatings are applied on an anodic oxidation coating for stacking, singly or mixed as material and in a single layer or stacked layers. A thickness of a ceramic coating is preferably 1 $\mu$m or more, or more preferably 5 $\mu$m or more in order to exert anti-corrosiveness to plasma; while the thickness is preferable to be large, if over 400 $\mu$m or more, cracking arises in a ceramic coating and by contraries, there arises a possibility of the anti-corrosiveness effect to plasma being deteriorated. Accordingly, a preferred range of thicknesses of a ceramic coating is 1 to 400 $\mu$m and a more preferred range thereof is 5 to 400 $\mu$m.

A ceramic coating can properly be applied by known methods such as an arc ion plating method, a sputtering method, a thermal spraying method, a chemical deposition method (CVD method) and the like. In the mean time, according to ways and conditions of the ceramic coating formation methods, there are possibilities that a carbide, free carbon or other impurities are included in the coating, but inclusion of the impurities are allowable as far as contents thereof do not exceed levels at which qualities of semiconductor and liquid crystal products or characteristics of ceramic coatings are adversely affected.

Al Alloy

Al alloys in the present invention are available as Al alloy families of JIS 2000, 3000, 5000, 6000, 7000 and the like, and as Al alloys under other JIS standards and the Al alloys are adopted while being selected properly corresponding to individual required specifications (strength, workability and heat resistance) of structural materials in various applications such as an electrode, a chamber and the like of production apparatuses for semiconductor and liquid crystal. Needless to say that an Al alloy composition in store can be modified to use.

Further, various forms of Al alloys can be used as start material intermediates of rolling, casting, forging and the like. The Al alloys as start material are used in a state as cast, after reception of plastic working or after thermal treatment including quenching and tempering, which are known and ordinary methods.

EXAMPLE GROUP 1

JIS 6061 Al alloy plates was each received anodic oxidation to form an anodic oxidation coating shown Table 1. The anodic oxidation was conducted in an electrolytic solution containing acid at a concentration of 1 to 250 g/l under an electrolysis voltage of 5 to 150 V (Nos. 1 to 27). Structure of the anodic oxidation coatings each with a porous layer and a barrier layer as shown in FIG. 1 were classified into three kinds: (a) a pore diameter and a cell diameter in the porous layer were unchanged to be same in the depth direction (Examples Nos. 2, 4, 5, 10, 15, 17, 19 to 23, 26 and 27 of Table 1), (b) a pore diameter and a cell diameter on the surface side of the porous layer were as small as possible and smaller than those on the base material side thereof and continuously changed in any division along the depth direction (Examples Nos. 1, 3, 7, 9, 11, 12, 14, 16 and 24 of Table 1) and (c) a pore diameter and a cell diameter on the surface side of the porous layer were as small as possible and smaller than those on the base material side thereof and discontinuously changed in any division along the depth direction (Examples Nos. 6, 8, 13, 18 and 25 of Table 1). When a pore diameter and a cell diameter were smaller on the surface side than those on the base material side, a electrolysis voltage was adjusted in the range of 10 to 50 or 80 V and a change in electrolysis voltage was continuously made in the case (b) and in an off-and-on way in the case (c).

Further, in inclusion of elements to an anodic oxidation coating, as electrolytic solutions oxalic acid was used for inclusion of C, phosphoric acid was used for inclusion of P, hydrofluoric acid was used for inclusion of F, boric acid was used for inclusion of B and sulfuric acid was used for inclusion of S. When the elements were intended to be included in a composite manner, the acids described above were mixed into one electrolytic solution according to a desired combination. In a more concrete manner of description, electrolytic solutions were prepared in the following ways: for example, an electrolytic solution of oxalic acid 30 g/l was used for C inclusion, an electrolytic solution of oxalic acid 30 g/l and sulfuric acid 5 g/l, or oxalic acid 22 g/l and sulfuric acid 170 g/l in the form of a mixed acid for inclusion of C and S, an electrolytic solution of oxalic acid 30 g/l, nitrous acid 5 g/l and sulfuric acid 3 g/l in the form of a mixed acid for inclusion of C, N and S and an electrolytic solution of phosphoric acid 60 g/l and sulfuric acid 60 g/l in the form of a mixed acid for inclusion of P and S. Thus, contents of the acids are adjusted and thereby contents of the corresponding elements were controlled and a prescribed quantities of the elements shown in Table 1 were made to be included into respective anodic oxidation coatings.

Structures of the thus treated anodic oxidation coatings were observed under an electron microscope and it was confirmed that the Examples Nos. 1 to 27 each were provided with a structure composed of the porous layer and barrier layer as shown in FIG. 1. In the examples of (a), it was confirmed that a pore diameter was in the range of 10 to 150 nm and a pore diameter of the porous layer did not change in the depth direction. Further, in the examples of (b), it was confirmed that, in the porous layer, a pore diameter on the surface side was in the range of 5 to 50 nm, while a pore diameter on the side of the base material side was in the range of 20 to 150 nm, a pore diameter was smaller on the surface side than that on the base material side and a pore diameter changed in any division in a continuous manner. Still further, in the examples of (c), it was confirmed that in the porous layer, a pore diameter on the surface side was in the range of 5 to 50 nm, while a pore diameter on the side of the base material was in the range of 20 to 150 nm, a pore diameter was smaller on the surface side than that on the base material side and a pore diameter changed in any direction in a discontinuous manner.

Al alloy plates respectively with such anodic oxidation coatings thereon were subjected to various methods for ceramic coatings shown in Table 1, that is a thermal spray method, an arc ion plating method (AIP method), a sputtering method and a CVD method, so as to form ceramic coatings made of oxides, nitrides, carbonitrides and borides on the anodic oxidation coatings. The Al alloy plates on which the anodic oxidation coatings and ceramic coatings were formed as a double coatings were tested in two stages: (1) an anti-corrosiveness test to halogen gas and (2) an anti-corrosiveness test to plasma, wherein adhesiveness of the coating under conditions of heat cycles and a corrosive environment and anti-corrosiveness to gas and plasma were tested. Results are shown in Table 1 as well.

Anti-corrosiveness to gas under conditions of heat cycles and a corrosive environment was tested through the anti-corrosiveness test to halogen gas (1). Concrete conditions of the test were in conformity with the severest ones for actually adopted working conditions of a semiconductor production apparatus such that an Al alloy plate test piece on which a double structure coating was formed was subjected to two times of exposure to a gas atmosphere of 5% $Cl_2$ containing Ar at 300° C. for 60 min and after the exposure, not only a corrosive state of the test piece was observed, but also a tape peeling test was applied to the test piece. Evaluation was expressed as follows: on a precondition of no separation of an anodic oxidation coating from an Al alloy surface, ◎ was used for indicating no separation of a ceramic coating and absolutely no occurrence of corrosion, ○ was used for indicating no separation of a ceramic coating but occurrence of defects on the surface, Δ was used for indicating a separated area of a ceramic coating being 25% or less of an Al alloy plate surface area and occurrence of some level of corrosion and X was used for indicating a separated area of a ceramic coating being more than 25% of an Al alloy plate surface area or occurrence of corrosion all over the surface.

Anti-corrosiveness to plasma was tested through the anti-corrosiveness test to plasma (2). Concrete conditions of the test were in conformity with the severest ones for actually adopted working conditions of a semiconductor production apparatus such that an Al alloy plate test piece on which a double structure coating was formed was subjected to four times of combined exposure to $Cl_2$ plasma for 60 min and $CF_4$ plasma for 30 min and then an etched amount was measured. Evaluation was expressed as follows: ◎ was used for indicating an etched amount being less than 0.7 μm, ○ was used for indicating an etched amount being 0.7 μm or more and less than 1 μm, Δ was used for indicating an etched amount being 1 μm or more and less than 2 μm and X was used for indicating an etched amount being 2 μm or more.

Comparative examples were prepared in two kinds in the same conditions as those for the examples with the exception of those specialized below: Comparative Examples Nos. 31 and 32 were performed such that any the elements of C, N, P, F and B were not contained but only S was contained and a ceramic coating was stacked on an anodic oxidation coating with an average surface roughness Ra 0.2 μm and Comparative Examples Nos. 28 to 30 were performed such that a ceramic coating was directly formed on an Al alloy surface with no anodic oxidation coating intercepted therebetween. The comparative examples were evaluated on adhesiveness of a coating and anti-corrosiveness to gas and plasma under conditions of high temperature heat cycles and a corrosive environment similar to the conditions for the examples. The preparation conditions for the anodic oxidation coatings and evaluation results are show in Table 1. In the mean time, while the anodic oxidation coatings of the comparative examples that had received anodic oxidation were observed with an electron microscope and it was confirmed as a result of the observation that the comparative examples Nos. 31 and 32 had anodic oxidation coatings each with a porous layer and a barrier layer as shown in FIG. 1.

As is apparent from Table 1, all of Examples 1 to 25, which each contain one of the elements C, N, P, F and B at a content 0.1% or more and each have an anodic oxidation coating with porous layer and a barrier layer therein, respectively show excellent results for either of (1) the anti-corrosiveness test to halogen gas and (2) the anti-corrosiveness test to plasma. Therefore, the results teach that if the requirements and preferred conditions are met, the combination of an anodic oxidation coating and a ceramic coating on an Al alloy shows good anti-corrosiveness to gas and plasma and adhesiveness between an anodic oxidation coating and a ceramic coating stacked thereon is excellent.

On the other hand, as can be seen from Table 1, Comparative Examples Nos. 28 to 30 are excellent in the anti-corrosiveness test to halogen gas, but inferior to the examples in the anti-corrosiveness to plasma. Further, Comparative examples Nos. 31 and 32 are inferior to the examples since corrosion and separation of a coating occur in (1) the anti-corrosiveness test to halogen gas and (2) the anti-corrosiveness test to plasma and the results in both tests are inferior to those in the corresponding tests of the examples. The reason why is that Comparative Examples Nos. 31 and 32 have no content of the elements C, N, P, F and B in the anodic oxidation coating and are especially poor in adhesiveness, which fundamentally guarantees the anti-corrosiveness to gas and plasma, between an anodic oxidation coating and a ceramic coating, which entails ceramic coating being separated.

TABLE 1

| | | anodic oxidation coatings | | | Ceramic coatings | | | (1) anti- | (2) anti- |
|---|---|---|---|---|---|---|---|---|---|
| Nos | Classification | contained elements (mass %) | thickness (μm) | structure | kinds of ceramic | thickness (μm) | Coating methods | corrosiveness test to halogen gas | corrosiveness test to plasma |
| 1 | Example | C:0.3, B:0.8 | 20 | b | $Al_2O_3$ | 200 | thermal spraying | ⊙ | ⊙ |
| 2 | Example | C:2.5, S:0.05 | 50 | a | $Al_2O_3$ | 200 | thermal spraying | ⊙ | ⊙ |
| 3 | Example | C:3.0 | 15 | b | $SiO_2$ | 20 | sputtering | ⊙ | ⊙ |
| 4 | Example | P:1.5, S:0.2 | 2 | a | AlN | 5 | sputtering | ⊙ | ⊙ |
| 5 | Example | P:2.0 | 5 | a | SiCN | 2 | sputtering | ○ | ⊙ |
| 6 | Example | B:0.1, P:0.1, S:1.5 | 20 | c | BN | 5 | sputtering | ⊙ | ○ |
| 7 | Example | C:0.1, S:1.5 | 75 | b | AlN | 100 | thermal spraying | ⊙ | ⊙ |
| 8 | Example | C:1.5, S:0.04, N:0.05 | 20 | c | $Si_3N_4$ | 50 | AIP | ○ | ○ |
| 9 | Example | C:0.8, N:0.1 | 2 | b | $B_2O_3$ | 100 | thermal spraying | ⊙ | ⊙ |
| 10 | Example | C:0.3, F:0.08 | 15 | a | $SiO_2$ | 100 | thermal spraying | ⊙ | ⊙ |
| 11 | Example | B:0.4, S:0.8 | 5 | b | $Al_2O_3$ | 10 | sputtering | ⊙ | ⊙ |
| 12 | Example | C:1.5, S:0.5 | 10 | b | $TiO_2$ | 100 | thermal spraying | ⊙ | ⊙ |
| 13 | Example | C:1.5, S:1.5, P:0.05 | 20 | c | TiN | 100 | AIP | ○ | ⊙ |
| 14 | Example | C:0.8, N:0.1 | 10 | b | $ZrO_2$ | 50 | thermal spraying | ⊙ | ⊙ |
| 15 | Example | C:0.3, F:0.08 | 2 | a | $SiO_2$ | 50 | thermal spraying | ⊙ | ⊙ |
| 16 | Example | B:0.4, S:2.5 | 80 | b | TiN + AlN | 10 | sputtering | ⊙ | ⊙ |
| 17 | Example | C:0.5, S:2.5 | 50 | a | $Al_2O_3$ + AlN | 5 | sputtering | ⊙ | ⊙ |
| 18 | Example | C:0.5,S:2.5 | 25 | c | $TiO_2$ + TiN | 70 | AIP | ⊙ | ⊙ |
| 19 | Example | C:0.5, S:2.5 | 50 | a | $Al_2O_3$ + $TiO_2$ | 10 | sputtering | ⊙ | ⊙ |
| 20 | Example | P:0.5, S:3.0 | 20 | a | AlN + $Si_3N_4$ | 50 | AIP | ○ | ⊙ |
| 21 | Example | C:0.5, S:2.5 | 10 | a | SiAlON | 2 | sputtering | ⊙ | ⊙ |
| 22 | Example | C:0.5, S:2.5 | 25 | a | $CrO_2$ | 250 | thermal spraying | ⊙ | ⊙ |
| 23 | Example | C:1.5, S:1.0 | 2 | a | $TiB_2$ | 1 | sputtering | ⊙ | ⊙ |
| 24 | Example | P:0.5, S:3.0 | 20 | b | $TiB_2$ + TiN | 5 | sputtering | ⊙ | ⊙ |
| 25 | Example | C:1.5, S:0.5 | 30 | c | BeO | 1 | sputtering | ⊙ | ⊙ |
| 26 | Example | C:1.5, S:0.1 | 40 | a | $Al_2O_3$ | 5 | CVD | ⊙ | ⊙ |
| 27 | Example | C:1.5, S:0.1 | 40 | a | $SiO_3$ | 2 | CVD | ⊙ | ⊙ |
| 28 | Comparative Example | — | — | — | $Al_2O_3$ | 200 | thermal spraying | ⊙ | x |
| 29 | Comparative Example | — | — | — | AlN | 10 | sputtering | ⊙ | x |
| 30 | Comparative Example | — | — | — | $SiO_2$ | 200 | thermal spraying | ⊙ | x |
| 31 | Comparative Example | S:2.5 (hard anodic oxidation coating) | 50 | a | $Al_2O_3$ | 300 | thermal spraying | thermal spraying separation | Δ |

TABLE 1-continued

| Nos | Classification | anodic oxidation coatings: contained elements (mass %) | anodic oxidation coatings: thickness (μm) | anodic oxidation coatings: structure | Ceramic coatings: kinds of ceramic | Ceramic coatings: thickness (μm) | Ceramic coatings: Coating methods | (1) anti-corrosiveness test to halogen gas | (2) anti-corrosiveness test to plasma |
|---|---|---|---|---|---|---|---|---|---|
| 32 | Comparative Example | S:1.8 (hard anodic oxidation coating) | 75 | a | $SiO_2$ | 200 | thermal spraying | thermal spraying separation | x |

EXAMPLE GROUP 2

Then, there are shown examples in each of which a carbide coating was formed as a ceramic coating on a JIS 6061 Al alloy plate. Conditions for anodic oxidation were same as those for formation coatings of corresponding compositions of Example Group 1 including incorporation of the elements C, N, P, F and B into an anodic oxidation coating and anodic oxidation coatings shown in Table 2 were formed. Incidentally, Examples Nos. 33 to 50 were performed in the same conditions as those in which Examples Nos. 1 to 18 of Example Group 1 were. Structure of the anodic oxidation coatings each with a porous layer and a barrier layer as shown in FIG. 1 were classified into three kinds: (a) a pore diameter and a cell diameter in the porous layer were unchanged to be same in the depth direction (Examples Nos. 33, 34, 37, 39, 42, 43, 45, 46, 50 and 52 of Table 1), (b) a pore diameter and a cell diameter on the surface side of the porous layer were smaller than those on the base material side thereof and continuously changed in any division along the depth (Examples Nos. 35, 36, 41, 47, 49, 51, 53, 54, 55, 56 and 57 of Table 1) and (c) a pore diameter and a cell diameter on the surface side of the porous layer were smaller than those on the base material side thereof and discontinuously changed in any division along the depth (Examples Nos. 38, 40, 44 and 48 of Table 1). The control methods applied to those examples were same as those in Example Group 1. In the mean time, only the anodic oxidation coating including only S of Example No. 57 had a average surface roughness Ra as rough as 0.35 μm and this roughness was obtained by roughening a surface of an Al alloy as compared with the other examples.

Inclusion of C and the like into an anodic oxidation coating was performed in the same conditions as those in which Example Group 1 was and amounts of the elements were adjusted by changing amounts of the acids so that prescribed amounts, shown in Table 2, of the respective elements were incorporated into anodic oxidation coatings.

Structures of the anodic oxidation coatings thus formed were observed with an electron microscope and Examples Nos. 33 to 56 were confirmed that anodic oxidation coatings each with a porous layer and a barrier layer as shown in FIG. 1 were formed. The marks indicating classification of a coating structure a, b and c were based on the same criteria as that in Table 1.

Al alloy plates having thus prepared anodic oxidation coatings were subjected to various coating methods as shown in Table 2 such as a thermal spraying method, an arc ion plating method (AIP method), a sputtering method and a CVD method so as to form respective ceramic carbide coatings thereon. The Al alloy plates on each of which a double coating composed of an anodic oxidation coating and a ceramic coating was formed were subjected to (1) the anti-corrosiveness test to halogen gas and (2) the anti-corrosiveness test to plasma in conditions as in Example Group 1 and evaluated about adhesiveness of coatings and the anti-corrosiveness to gas and plasma. Results are shown in Table 2 as well.

For comparison, four kinds of Comparative Examples were prepared in the same conditions as those for the examples with the exception of those specialized below: Comparative Examples Nos. 61, 62 and 64 in each of which any of the elements C, N, P, F and B were not included but only S was included and carbide coatings were stacked on anodic oxidation coatings each with an average surface roughness Ra 0.2 μm, Comparative Examples Nos. 58 and 59 in each of which an anodic oxidation coating was not formed and a carbide coating was deposited directly on an Al alloy plate surface, Comparative Example No. 60 in which an anodic oxidation coating was not formed and an oxide coating was deposited directly on an Al alloy plate surface and Comparative Example No. 63 in which only an anodic oxidation coating that did not contain any of the elements C, N, P, F and B was formed. Adhesiveness of a coating under conditions of high temperature heat cycles and a corrosive environment and anti-corrosiveness to gas and plasma were evaluated. The conditions for forming the anodic oxidation coatings and evaluation results are shown in Table 2. In the mean time, anodic oxidation coatings of the comparative examples were observed with an electron microscope and Comparative Examples Nos. 61 to 64 each had an anodic oxidation coating having a porous layer and a barrier layer shown in FIG. 1.

As is apparent from Table 2, Examples Nos. 33 to 56 in each of which an anodic oxidation coating that includes one of the elements C, N, P, F and B at a content 0.1% or more, and which is composed of a porous layer and a barrier layer, showed excellent results in (1) the anti-corrosiveness test to halogen gas and (2) the anti-corrosiveness test to plasma. Therefore, the results teach that if the requirements and preferred conditions are met, the combination of an anodic oxidation coating and a ceramic coating on an Al alloy shows good anti-corrosiveness to gas and plasma and adhesiveness, which guarantees the anti-corrosiveness to both gas and plasma, between an anodic oxidation coating and a ceramic coating stacked thereon is also excellent. Further, even the anodic oxidation coating including only S of Example No. 57 has a performance equivalent to those of the other examples by roughening a surface roughness Ra of the anodic oxidation coating to be as rough as 0.35 μm.

On the other hand, as can be seen form Table 2, while Comparative Examples Nos. 58 to 60 is excellent in (2) anti-corrosiveness test to gas, the comparative examples are poor in (1) anti-corrosiveness test to plasma compared with the examples. Further, Comparative Examples Nos. 61 to 64 are inferior to the examples since corrosion and separation of a coating occur in (1) the anti-corrosiveness test to halogen gas and (2) the anti-corrosiveness test to plasma.

The reason why is that Comparative Examples Nos. 61, 62 and 64 do not have any of the elements C, N, P, F and B, especially, adhesion, which fundamentally guarantees anti-corrosiveness to gas and plasma, between an anodic oxidation coating and a ceramic coating is poor and thereby separation of a carbide coating occurs. Further, another reason why in the case of Comparative Example No. 63 is that Comparative Example No. 63 has no carbide coating that guarantees the anti-corrosiveness to gas and plasma.

TABLE 2

| | | anodic oxidation coatings | | | Ceramic coatings | | | (1) anti- | (2) anti- |
|---|---|---|---|---|---|---|---|---|---|
| Nos | Classification | contained elements (mass %) | thickness (μm) | structure | kinds of ceramic | thickness (μm) | Coating methods | corrosiveness test to halogen gas | corrosiveness test to plasma |
| 33 | Example | C:1.5, B:0.2 | 15 | a | SiC | 250 | thermal spraying | ⊙ | ⊙ |
| 34 | Example | C:2.3, S:0.1 | 75 | a | SiC | 10 | CVD | ⊙ | ⊙ |
| 35 | Example | C:2.5 | 5 | b | SiC | 80 | AIP | ⊙ | ⊙ |
| 36 | Example | P:1.5, S:1.5 | 20 | b | WC | 15 | sputtering | ○ | ○ |
| 37 | Example | P:2.5 | 3 | a | TiC | 40 | AIP | ⊙ | ⊙ |
| 38 | Example | B:0.1, P:2.0 | 5 | c | Zrc | 100 | AIP | ○ | ⊙ |
| 39 | Example | C:0.1, S:1.5, B:0.2 | 50 | a | SiC | 50 | AIP | ⊙ | ⊙ |
| 40 | Example | C:1.5, S:0.04 | 15 | c | TiC | 80 | AIP | ⊙ | ⊙ |
| 41 | Example | C:0.8 | 15 | b | TiC + HFC | 40 | AIP | ⊙ | ⊙ |
| 42 | Example | C:0.2, S:2.5 | 35 | a | TiC + $TiO_2$ | 200 | thermal spraying | ⊙ | ○ |
| 43 | Example | C:1.5 | 15 | a | SiC | 15 | sputtering | ⊙ | ⊙ |
| 44 | Example | B:0.2, S:2.5 | 25 | c | $V_2C$ | 5 | CVD | ⊙ | ○ |
| 45 | Example | C:2.5, S:0.5 | 50 | a | HfC | 5 | CVD | ○ | ⊙ |
| 46 | Example | C:2.5, S:0.5 | 50 | a | SiC + $SiO_2$ | 120 | thermal spraying | ⊙ | ○ |
| 47 | Example | C:1.5, S:0.5 | 25 | b | SiC + $SiO_2$ | 80 | AIP | ⊙ | ○ |
| 48 | Example | P:1.5, S:0.5 | 10 | c | TiC + $TiO_2$ | 50 | AIP | ⊙ | ○ |
| 49 | Example | C:1.5, S:0.5 | 25 | b | SiC + WC | 200 | thermal spraying | ⊙ | ⊙ |
| 50 | Example | P:1.5, S:0.5 | 25 | a | TiC + TiN | 10 | sputtering | ⊙ | ⊙ |
| 51 | Example | C:0.1, S:2.5 | 50 | b | SiC | 80 | thermal spraying | ⊙ | ⊙ |
| 52 | Example | P:0.5, S:3.0 | 75 | a | SiC + $SiO_2$ | 200 | thermal spraying | ⊙ | ○ |
| 53 | Example | C:0.5, S:2.5 | 75 | b | SiC | 100 | AIP | ⊙ | ⊙ |
| 54 | Example | C:0.2, S:2.5 | 75 | b | SiC + $SiO_2$ | 100 | AIP | ⊙ | ○ |
| 55 | Example | C:0.1, S:2.5 | 50 | b | $CO_3C$ | 5 | sputtering | ⊙ | ○ |
| 56 | Example | P:0.1, S:2.5 | 50 | b | $Cr_3C_2$ | 5 | sputtering | ⊙ | ⊙ |
| 57 | Example | S:4.5 | 40 | a | SiC | 150 | thermal spraying | ○ | ⊙ |
| 58 | Comparative Example | — | — | — | SiC | 100 | thermal spraying | ○ | x |
| 59 | Comparative Example | — | — | — | TiC | 5 | CVD | ○ | x |
| 60 | Comparative Example | — | — | — | $Al_2O_3$ | 200 | thermal spraying | ○ | x |
| 61 | Comparative Example | S:2.5 (hard anodic oxidation coating) | 50 | a | SiC + $SiO_2$ | 200 | thermal spraying | thermal spraying separation | x |
| 62 | Comparative Example | S:1.8 (hard anodic oxidation coating) | 75 | a | SiC | 150 | AIP | thermal spraying separation | Δ |
| 63 | Comparative Example | S:1.8 (hard anodic oxidation coating) | 50 | a | — | — | — | x | x |
| 64 | Comparative Example | S:2.5 (hard anodic oxidation coating) | 50 | a | WC + TiC | 50 | AIP | thermal spraying separation | Δ |

EXAMPLE GROUP 3

Anodic oxidation was performed on JIS 5052 Al alloy plates in a method similar to those in Example Groups 1 and 2 to form anodic oxidation coatings shown in Table 3. The same conditions for anodic oxidation as those for coatings of corresponding compositions of Example Groups 1 and 2 including incorporation of the elements C, N, P, F and B were adopted. Structure of the anodic oxidation coatings each with a porous layer and a barrier layer as shown in FIG. 1 were classified into three kinds: (a) a pore diameter and a cell diameter in the porous layer were unchanged to be same in the depth direction (Examples Nos. 65, 68, 69, 70, 73 and 75 of Table 3), (b) a pore diameter and a cell diameter on the base material side of the porous layer were large than those on the surface side thereof and continuously changed in any division along the depth (Examples Nos. 66, 67, 74, 76 and 77 of Table 3) and (c) a pore diameter and a cell diameter on the base material side of the porous layer were larger than those on the surface side thereof and discontinuously changed in any division along the depth (Examples Nos. 71 and 72 of Table 3). Electrolysis voltage conditions for the cases of (b) and (c) were the same as those for the cases of (b) and (c) of Example Group 1.

Structures of the anodic oxidation coatings thus formed were observed with an electron microscope and Examples Nos. 65 to 77 were confirmed that anodic oxidation coatings each with a porous layer and a barrier layer as shown in FIG. 1 were formed. The marks indicating classification of a coating structure a, b and c were based on the same criteria as that in Table 1. Inclusion of C and the like into an anodic oxidation coating was performed in the same conditions as those in Example Groups 1 and 2 and contents of the respective elements were adjusted by changing amounts of acids to incorporate prescribed amounts, which are shown in Table 3, of the respective elements into anodic oxidation coatings. In the mean time, only the anodic oxidation coating of Example No. 78 which included only S had a surface roughness Ra as rough as 0.35 $\mu$m of the anodic oxidation coating by roughening the surface of the Al alloy, compared with the other examples.

Carbide ceramic coatings were formed as shown in Table 3 by means of various methods same as used in Example Groups 1 and 2 on Al alloy plates on each of which an anodic oxidation coating was already formed. For comparison, two kinds of comparative examples were prepared in the same conditions as those for the examples with the exception of those specialized below; Comparative Examples Nos. 79, 80 and 81 in each of which any of the elements C, N, P, F and B were not included but only S was included and carbide and oxide coatings were stacked on anodic oxidation coatings each with an average surface roughness Ra 0.2 $\mu$m and Comparative Example No. 82 in which a ceramic coating was not formed. Anodic oxidation coatings of Comparative Examples Nos. 79 to 82 were observed with an electron microscope and as a result, anodic oxidation coatings each had a porous layer and a barrier layer shown in FIG. 1 and the pore diameter was in the range of 10 to 150 nm and did not change to be same in the depth direction, which coating was of the type of the above described (a).

The Al alloy plates on which the coatings were formed were subjected to an anti-corrosiveness test to $BCl_3$ plasma and evaluated on etching of a coating under the conditions of heat cycles and an corrosive environment. Results are shown in Table 3 as well. An anti-corrosiveness test to $BCl_3$ on a coating under the conditions of heat cycles and an corrosive environment was conducted in particular test conditions in conformity with actual working process conditions of a semiconductor production apparatus, wherein an Al alloy plate on which a coating described above thereon was subjected to four times of exposures to $BCl_3$ plasma for 60 min and thereafter, an etched amount was measured. Evaluation was expressed as follows: ⊙ was used for indicating an etched amount being less than 0.1 $\mu$m, ○ was used for indicating an etched amount being 0.1 $\mu$m to 0.5 $\mu$m or occurrence of fine' defects on the surface and x was used for indicating an etched amount being more than 0.5 $\mu$m.

Examples Nos. 65 to 77 in each of which an anodic oxidation coating and a ceramic coating were formed, the anodic oxidation coating having included one of the elements C, N, P, F and B at a content 0.1% or more and been composed of a porous layer and a barrier layer, showed excellent results in the anti-corrosiveness test to $BCl_3$ since an etched amount was less than 0.1 $\mu$m except for Example Nos. 68 and 73, where the etched amount was 0.1–0.5 $\mu$m. Therefore, the results teach that if the requirements and preferred conditions are met, anti-corrosiveness to $BCl_3$ is excellent. Even the anodic oxidation coating of Example No. 78, which included only S had a performance equivalent to the other examples since a surface roughness Ra was roughened as rough as 0.35 $\mu$m.

On the other hand, as can be seen from Table 3, Comparative Examples Nos. 79 to 82, which are conventional hard anodic oxidation coatings, and which do not satisfy the conditions required by the present invention or which do not form a ceramic coating, are found to be greatly poorer than the examples in the anti-corrosiveness test to $BCl_3$.

TABLE 3

| | | anodic oxidation coatings | | | Ceramic coatings | | | (1) anti- |
|---|---|---|---|---|---|---|---|---|
| Nos | Classification | contained elements (mass %) | thickness ($\mu$m) | structure | kinds of ceramic | thickness ($\mu$m) | Coating methods | corrosiveness test to plasma |
| 65 | Example | C:2.3, S:0.1 | 50 | a | SiC | 20 | CVD | ⊙ |
| 66 | Example | C:2.5 | 5 | b | TiC + $TiO_2$ | 40 | AIP | ⊙ |
| 67 | Example | P:1.5, C:1.6 | 20 | b | SiC+ $SiO_2$ | 150 | thermal spraying | ⊙ |
| 68 | Example | C:0.2, S:2.5 | 35 | a | WC | 5 | CVD | ○ |
| 69 | Example | C:3.0 | 50 | a | ZrC | 5 | sputtering | ⊙ |
| 70 | Example | C:2.5, S:0.5 | 70 | a | TiC + HIC | 40 | AIP | ⊙ |
| 71 | Example | C:1.5, S:0.5 | 25 | c | SiC | 60 | AIP | ⊙ |
| 72 | Example | P:1.5, S:0.5 | 30 | c | $Ta_2C$ | 5 | sputtering | ⊙ |
| 73 | Example | C:1.5, S:0.5 | 70 | a | SiC + $SiO_2$ | 100 | thermal spraying | ○ |
| 74 | Example | C:0.1, S:2.5 | 50 | b | SiC | 80 | thermal spraying | ⊙ |
| 75 | Example | C:0.5, S:3.0 | 75 | a | SiC + $SiO_2$ | 200 | thermal spraying | ⊙ |
| 76 | Example | C:0.2, S:2.5 | 75 | b | SiC | 100 | AIP | ⊙ |
| 77 | Example | C:0.1, S:2.6 | 75 | b | SiC + $SiO_2$ | 100 | AIP | ⊙ |

TABLE 3-continued

| | | anodic oxidation coatings | | | Ceramic coatings | | | (1) anti- |
|---|---|---|---|---|---|---|---|---|
| Nos | Classification | contained elements (mass %) | thickness ($\mu$m) | structure | kinds of ceramic | thickness ($\mu$m) | Coating methods | corrosiveness test to plasma |
| 78 | Example | S:4.5 | 40 | a | SiC | 150 | thermal spraying | ○ |
| 79 | Comparative Example | S:2.8 (hard anodic oxidation coating) | 50 | a | SiC + $SiO_2$ | 60 | AIP | thermal spraying separation |
| 80 | Comparative Example | S:1.8 (hard anodic oxidation coating) | 75 | a | TiC | 80 | AIP | thermal spraying separation |
| 81 | Comparative Example | S:1.8 (hard anodic oxidation coating) | 75 | a | $Al_2O_4$ | 150 | thermal spraying | thermal spraying separation |
| 82 | Comparative Example | S:2.8 (hard anodic oxidation coating) | 50 | a | — | — | — | x |

As described above, according to the present invention, there can be provided structural material excellent in anti-corrosiveness to gas and plasma of constituent members of production apparatuses for semiconductor and liquid crystal. Accordingly, a trend toward higher efficiency and being lighter in weight can be accelerated, which in turn enables efficient production of semiconductor and liquid crystal each with high performance.

What is claimed is:

1. Aluminum alloy comprising an anodic oxidation coating and a ceramic coating formed on a surface of the anodic oxidation coating, wherein the anodic oxidation coating contains one or more elements selected from the group consisting of C, N, P, F, B and S at a content of each element in an amount of 0.1 mass % or more, and wherein the ceramic coating comprises one or more selected from the group consisting of oxide, nitride, carbonitride, boride and silicide, wherein when the anodic oxidation coating contains S only, the surface of the aluminum alloy or of the anodic oxidation coating has an average roughness Ra of 0.3 $\mu$m or more.

2. Aluminum alloy according to claim 1, wherein the ceramic coating is made of oxides, nitrides, carbonitrides, borides and/or silicides of one or more elements selected from the group consisting of Si, Al, B, 4A group elements, 5A group elements and 6A group elements.

3. Aluminum alloy excellent in anti-corrosiveness to gas and plasma according to claim 2, wherein the anodic oxidation coating comprises a porous layer having many pores each with an opening on a surface and a barrier layer, and a pore diameter or a cell diameter continuously or discontinuously changes in any division in a depth direction, or alternatively pore diameters continuously change in any division of each of some pores and discontinuously change in any division of the other pores, or cell diameters continuously change in any division of each of some cells and discontinuously change in any division of the other cells.

4. Aluminum alloy according to claim 1, wherein the anodic oxidation coating comprises a porous layer having many pores each with an opening on a surface and a barrier layer, and a pore diameter or a cell diameter continuously or discontinuously changes in any division in a depth direction, or alternatively pore diameters continuously change in any division of each of some pores and discontinuously change in any division of the other pores, or cell diameters continuously change in any division of each of some cells and discontinuously change in any division of the other cells.

5. Aluminum alloy according to claim 1, wherein the thickness of the anodic oxidation coating is 0.05 $\mu$m or more, and the thickness of the ceramic coating is from 1 to 400 $\mu$m.

6. Aluminum alloy according to claim 5, wherein the anodic oxidation coating has a thickness of 0.1 $\mu$m or more, and the thickness of the ceramic coating is from 5 to 400 $\mu$m.

7. Aluminum alloy comprising an anodic oxidation coating and a ceramic coating formed on a surface of the anodic oxidation coating, wherein the anodic oxidation coating contains one of more elements selected from the group consisting of C, N, P, F, B and S at a content of each element in a amount of 0.1 mass % more, and wherein the ceramic coating comprises one or more selected from the group consisting of carbides expressed by MC, wherein M is any of Si, Ti, Zr, Hf, V, Nb, Ta and Mo; carbides expressed by $M_2C$, wherein M is any of V, Ta, Mo and W; carbides expressed by $M_3C$, wherein M is any of Mn, Fe, Co and Ni; and carbides expressed by $M_3C_2$, wherein M is Cr, wherein when the anodic oxidation coating contains S only, the surface of the aluminum alloy or of the anodic oxidation coating has an average roughness Ra of 0.3 $\mu$m or more.

8. Aluminum alloy excellent in anti-corrosiveness to gas and plasma according to claim 7, wherein the anodic oxidation coating comprises a porous layer having many pores each with an opening on a surface and a barrier layer, and a pore diameter or a cell diameter continuously or discontinuously changes in any division in a depth direction, or alternatively pore diameters continuously change in any division of each of some pores and discontinuously change in any division of the other pores, or cell diameters continuously change in any division of each of some cells and discontinuously change in any division of the other cells.

9. Aluminum alloy comprising an anodic oxidation coating and a ceramic coating formed on a surface of the anodic oxidation coating, wherein the anodic oxidation coating contains one or more elements selected from the group consisting of C, N, P, F, B and S at a content of each element in an amount of 0.1 mass % or more, and wherein the ceramic coating comprises one or more selected from the group consisting of oxide, nitride, carbonitride, boride and silicide, and excluding chromium oxides, wherein when the anodic oxidation coating contains S only, the surface of the aluminum alloy or of the anodic oxidation coating has an average roughness Ra of 0.3 $\mu$m or more.

* * * * *